United States Patent [19]

Wilkinson

[11] Patent Number: 4,858,785

[45] Date of Patent: Aug. 22, 1989

[54] MULTIPLE FLUID DISPENSER

[75] Inventor: William T. Wilkinson, Kemblesville, Pa.

[73] Assignee: Package Research Corporation, Cleveland, Ohio

[21] Appl. No.: 164,454

[22] Filed: Apr. 4, 1988

[51] Int. Cl.[4] ..... B65D 35/22

[52] U.S. Cl. ..... 222/145; 222/386; 239/321

[58] Field of Search ..... 222/145, 206, 209, 211, 222/212, 215, 386, 387; 239/327, 304, 320, 321, 322, 323, 429

[56] References Cited

U.S. PATENT DOCUMENTS

| | | | |
|---|---|---|---|
| 2,510,264 | 6/1950 | Winter | 222/212 |
| 2,914,220 | 11/1950 | Marraffino | 222/145 |
| 3,217,931 | 11/1965 | Farrar et al. | 239/327 |
| 3,241,722 | 3/1966 | Nissen | 222/145 |
| 3,747,804 | 7/1973 | Raaf et al. | 222/145 |
| 3,870,200 | 3/1975 | Spatz | 222/386 |
| 4,014,463 | 3/1977 | Hermann | 222/145 |
| 4,022,351 | 5/1977 | Wright | 222/212 |
| 4,474,313 | 10/1984 | Sieverding | 222/386 |
| 4,685,597 | 8/1987 | Hirao et al. | 222/397 |

*Primary Examiner*—Andres Kashnikow
*Assistant Examiner*—Kavin P. Weldon
*Attorney, Agent, or Firm*—Connolly & Hutz

[57] ABSTRACT

A dispenser for two distinct fluids includes a container having a chamber for each of the fluids. The fluid chambers communicate with a mixing chamber at the top of the container leading to a dispensing spout. Mixing ports in the wall of the mixing chamber permit the fluids to mix before being dispensed from the container.

10 Claims, 3 Drawing Sheets

MULTIPLE FLUID DISPENSER

BACKGROUND OF INVENTION

Various dispensers exist for different types of fluids. In particular, there are many dispensers for fluids such as toothpaste. These dispensers generally take complicated forms, which are costly to manufacture and/or difficult to use.

Dispensers also exist for single fluids. One approach taken in the prior art is disclosed in U.S. Pat. No. 3,870,200 which is a valveless dispenser for fluid materials such as toothpaste or cream. This dispenser is in the form of a container having a plunger mounted at its lower end in such a manner that the plunger is capable of movement in only one direction, namely upwardly in the container. The top wall of the container is in the form of a flexible diaphragm to which the dispensing spout is mounted. In order to dispense the material the spout is deflected or tilted from its normal position to distort the diaphragm and thus cause an internal pressure in the container causing the fluid to flow through and out of the spout.

While the arrangement of U.S. Pat. No. 3,870,200 provides certain advantages it also has limitations. For example, the patented arrangement is capable of dispensing only a single fluid. Additionally, the patented arrangement is specifically a valveless dispenser which in turn leads to the possibility of being ineffective in its operation.

There is a need for a dispenser which could be simple and economical to manufacture and easy to use but which is capable of dispensing more than one fluid. For example, such a dispenser would be desirable for dispensing toothpaste having a major component of one color with a secondary component of another color so that the toothpaste actually being dispensed would be multi-colored.

SUMMARY OF INVENTION

An object of this invention is to provide such a dispenser which meets the above needs.

In accordance with this invention the dispenser is in the form of a container open at its bottom end and closed at its top. A dispensing spout is formed at the top of the container in communication with its interior. The major volume of the container comprises a first chamber having a fluid therein with the first chamber extending from the lower end of the container toward the upper end. A second chamber is disposed at the upper end downstream from the first chamber and contains the second fluid. Both chambers may be separated from each other by a flexible diaphragm. In the preferred embodiment, however, the diaphragm is omitted. The first chamber communicates with an axially located mixing chamber which is in direct communication with the axially located dispensing spout. The second chamber forms a sleeve around the mixing chamber. The mixing chamber includes mixing ports in its peripheral wall so that fluids may flow from the second chamber through the mixing ports and thereby mix with the fluid from the first chamber. In the preferred form of this invention the mixing is in the form of a coating of the second fluid as spaced stripes on the first fluid. The dispensing takes place in a manner similar to U.S. Pat. No. 3,870,200 (the details of which are incorporated herein by reference thereto) by tilting the spout so as to distort the diaphragm and thereby create internal pressures within the container to force the fluids outwardly into the mixing chamber and from the spout. The bottom of the container is closed by a plunger mounted for one way movement.

In a preferred form of this invention the mixing chamber includes an upper neck and a lower neck with a outwardly diverging skirt extending from the lower neck. A ball valve is located between the upper and lower necks. The lower neck functions as a valve seat for closing the mixing chamber during periods of non-use of the dispenser. The peripheral skirt acts as a flow channel to help direct the first fluid into the mixing chamber. The upper neck functions as a retainer to maintain the ball valve in the mixing chamber.

In accordance with a further feature of this invention, pairs of ridges are provided around the periphery of the upper neck on side of the mixing ports to maintain an open space or channels around the upper neck so that the ball valve cannot close communication when it contacts the upper neck.

THE DRAWINGS

Figure 2:
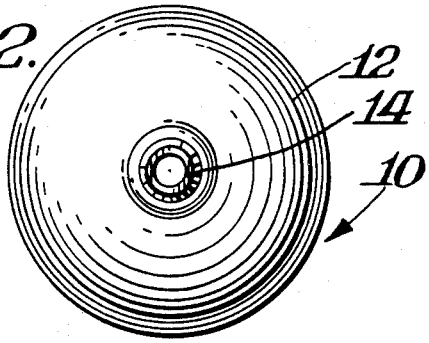
FIG. 2 is a top plan view of the dispenser shown in FIG. 1.
Figure 4:
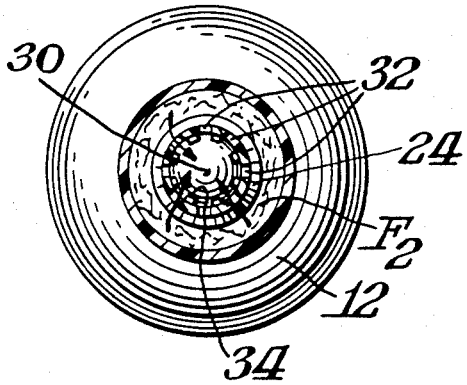
Figure 1:
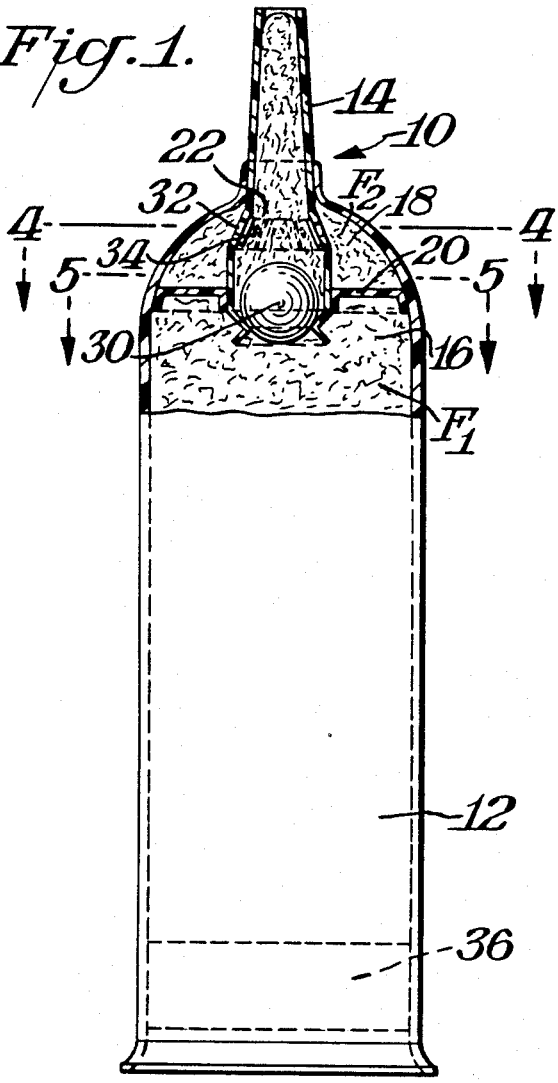
FIG. 1 is a side elevation view partially in section of a dispenser in accordance with this invention.
Figure 5:
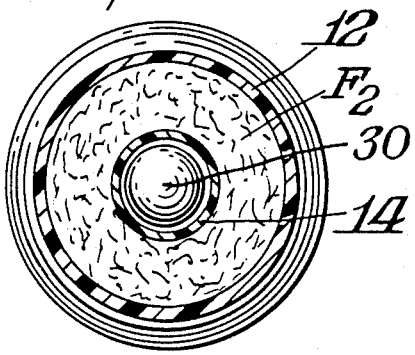
Figure 6:
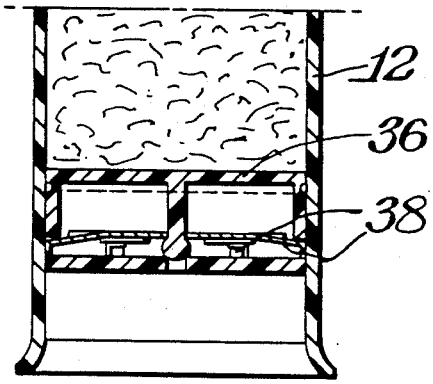
Figure 3:
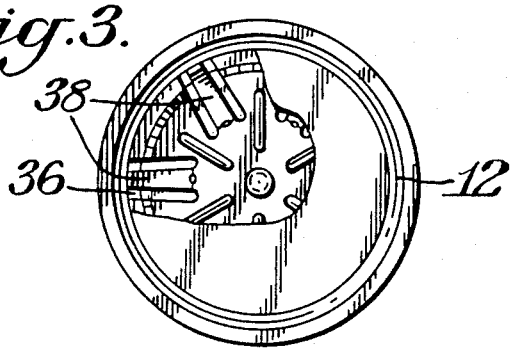
FIG. 3 is a bottom plan view partly in section of the dispenser shown in FIGS. 1–2.
Figure 7:
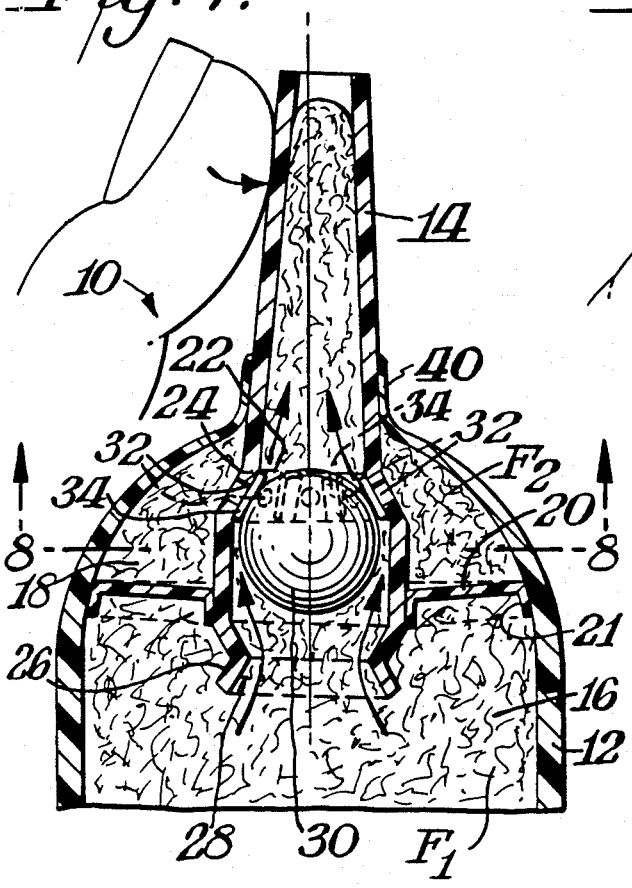
Figure 9:
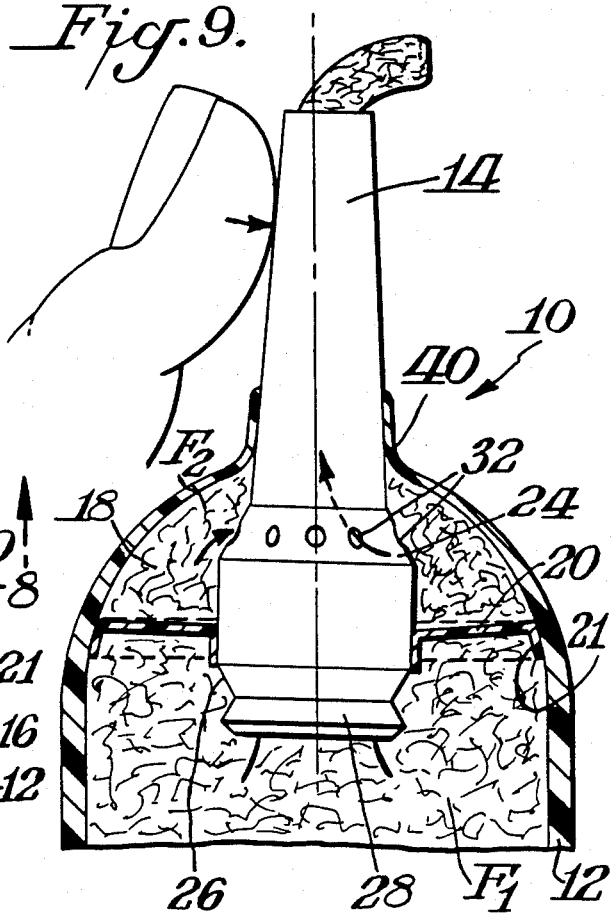
Figure 8:
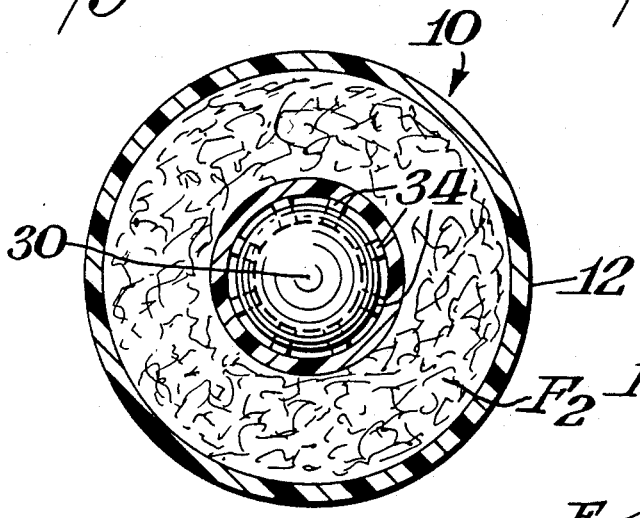
Figure 10:
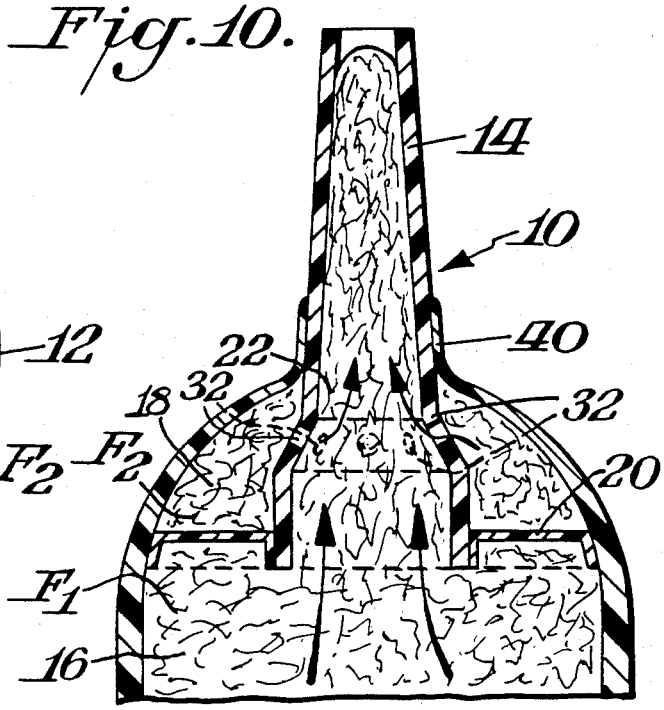
Figure 11:
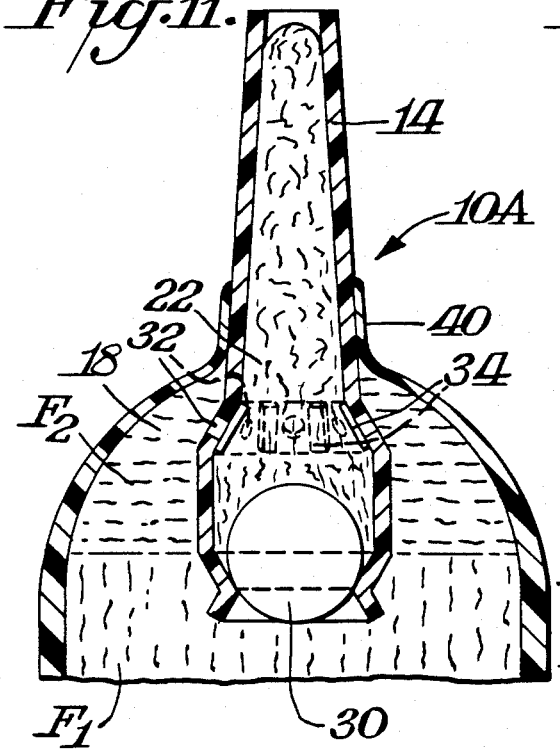
Figure 12:
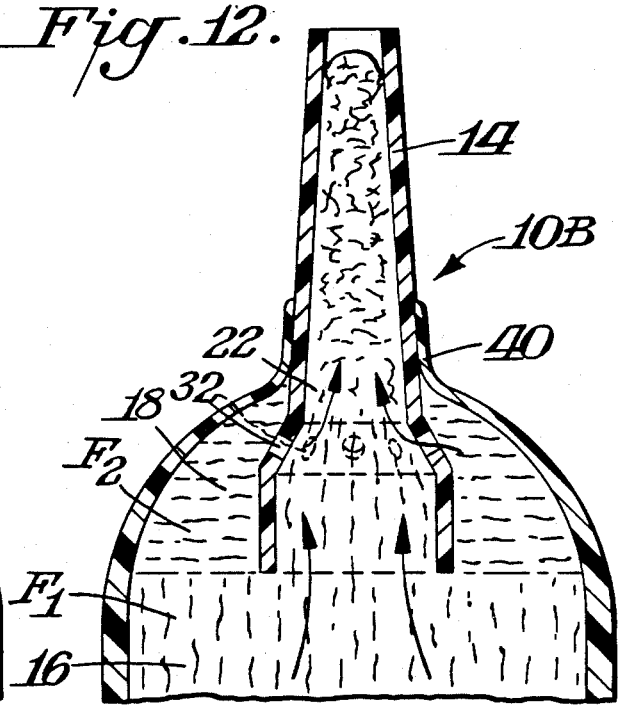

FIGS. 4 and 5 are cross-sectional views taken through FIG. 1 along the lines 4—4 and 5—5;

FIG. 6 is a cross-sectional view in elevation of a portion of the dispenser shown in FIGS. 1–5;

FIG. 7 is a cross-sectional view in elevation of the dispenser shown in FIGS. 1–6 in the initial stage of dispensing;

FIG. 8 is a cross-sectional view taken through FIG. 7 along the line 8—8;

FIG. 9 is a view similar to FIG. 7 in the final stage of dispensing; and FIGS. 10–12 are cross-sectional views in elevation similar to FIG. 7 of alternative forms of this invention.

DETAILED DESCRIPTION

FIG. 1 illustrates a dispenser 10 in accordance with this invention. As shown therein dispenser 10 is in the form of a container 12 cylindrically shaped and having an open lower end and a closed upper end. A dispensing spout 14 is secured at the upper end and communicates with the interior of container 12.

As shown in FIG. 1 a first chamber 16 is formed in container 12 and extends from its lower end to the upper end. A first fluid $F_1$ fills first chamber 16. Fluid $F_1$ may for example be a toothpaste of a particular color such as white. A second chamber 18 is at the upper end of container 12 and contains a second fluid $F_2$ which in the case of toothpaste would be a second color intended to form stripes on fluid $F_1$ so that the mixed composite flowing from spout 14 would be a striped toothpaste.

As shown in the various Figures the diaphragm 20 extends across the upper end of container 12 and is mounted to the interior wall at 21 and then is secured to a mixing chamber 22 coaxially arranged at the upper end of container 12. Mixing chamber 22 is an extension of spout 14. As shown for example, in FIG. 7, mixing chamber 22 includes an upper neck 24 and a lower neck 26. A skirt 28 diverges outwardly from lower neck 26 to act as a guide passage for fluid Fl to flow into mixing chamber 22. Lower neck 26 also comprises a valve seat for ball valve 30 located in mixing chamber 22. As shown in FIG. 1 during the non-use condition ball valve 30 closes communication between lower chamber 16 and mixing chamber 22.

A plurality of equally spaced dispensing ports 32 are located around upper neck 24 to provide communication between chamber 18 and mixing chamber 22. In order to assure that such communication is maintained a plurality of ridges 34 are located in pairs with one ridge on each side of each dispensing port on the interior surface of tapered upper neck 24 to assure that the mixing ports will never be closed even when ball valve 30 is in its upper most position.

As shown in FIG. 6 the lower end of container 12 is closed by a piston of plunger member 36 having spring fingers 38 reacting against the inner surface of wall 12 so that plunger 36 may move only in the upward direction.

The extreme upper end of container 12 has a neck portion 40 made of a yieldable material which is secured to spout 14 in such a manner as to maintain a seal around spout 14 and yet permit spout 14 to be depressed from its normal axial position.

In use each chamber 16 and 18 would be filled with the appropriate fluid $F_1$ and $F_2$. Ball valve 30 would be seated against neck 26 to close communication between chamber 16 and mixing chamber 22. When it is desired to dispense fluid spout 14 would be deflected as shown in FIG. 9 distorting diaphragm 20 to create internal pressures generally along the same lines as in U.S. Pat. No. 3,870,200 to cause the fluid $F_1$ to move upwardly and to unseat valve 30 and then to move around ball valve 30 towards spout 14. The internal pressures would also cause fluid $F_2$ to flow from chamber 18 through mixing ports 24 where they would coat fluid $F_1$ thereby creating a composite in which fluid $F_1$ would comprise the main portion of the mixture with fluid $F_2$ being in the form of spaced longitudinal stripes.

An alternative mode of operation would be to permit spout 14 to remain in its axial position and apply pressure to plunger 36 so as to create the internal forces which result in the mixing of the fluids and their dispensing from spout 14.

Although not illustrated during non-use a cap or any other suitable closure would be provided at the exposed end of spout 14.

The provision of ball valve 30 is particularly desirable since it aids in dispensing a metered amount of the fluids. Additionally, because the ball valve provides a positive closure, the safety and hygenic aspects are enhanced in minimizing exposure of the contents of the dispenser.

FIG. 10 shows an alternative embodiment in which ball valve 30 is omitted. Accordingly, in this embodiment it is not necessary to provide a lower neck to function as a valve seat.

The various components of dispenser 10 may be made from any suitable materials such as molded plastics as is known in the art. Similarly, plunger 36 may take any suitable construction to provide its one way movement such as the type of construction in U.S. Pat. No. 3,870,200. It is noted that in the mode of operation in which the dispensing is effected by deflecting spout 14 a partial vacuum would be created which should be sufficient to automatically draw plunger 36 upwardly and maintain it in contact with fluid $F_1$, otherwise a slight application of pressure to plunger 36 from the open lower end of container 12 would maintain the contact between plunger 36 and the fluid $F_1$ in chamber 16.

The operation of dispenser 10 may be considered as resulting from the deflection of spout 14 which creates a pressure acting as a force movement traveling down spout 14 to diaphragm 22 which causes the pressure to be exerted on the contents of container 12. The contents then seek the path of least resistance and travel out of the open spout 14. Back pressure on the bottom plunger 36 is resisted by the metal dogs or spring fingers 38 that are arranged for one-way movement. Release of the pressure on spout 14 results in the flexible diaphragm 22 returning to its original shape, thus creating a partial vacuum that tends to draw the contents backwards down the spout 14 and force ball valve 30 into contact with valve seat 26. The provision of ball valve 30 while not absolutely necessary does provide a security measure to close off chamber 16 and thus assure that fluid $F_1$ will not flow into mixing chamber 22 and be dispensed from spout 14 when a dispensing operation is not intended.

FIG. 11 illustrates the preferred form of this invention wherein the diaphragm separating the chambers is omitted. During loading one fluid is placed directly on top of the other.

FIG. 12 illustrates a further modification which combines the features of FIGS. 10 and 11 by omitting both the diaphragm and the ball valve. This arrangement is the embodiment of the invention in its simplest form.

Although dispenser 10 has been described in particular reference to the dispensing of colored toothpaste, it is to be understood that dispenser 10 may be used for dispensing any types of distinct fluids, such as creams, pastes and the like.

What is claimed is:

1. A dispenser for dispensing two distinct fluids from a common outlet comprising a container open at its bottom and closed at its top, a dispensing spout at said top of said container in communication with the interior of said container, a first chamber in said container extending from the lower end of said container to the upper end of said container, a first fluid in said first chamber, a second chamber in said container at said upper end, a second fluid in said second chamber, an axially disposed mixing chamber communicating with said spout and with said first chamber and with said second chamber, said second chamber being a sleeve around said mixing chamber, said mixing chamber being an extension of said spout at the lower end of said pout, said mixing chamber being open at its lower end and in axial communication with said first chamber, mixing ports around the periphery of said mixing chamber communicating with said second chamber whereby said second fluid may flow through said ports and mix with said first fluid in said mixing chamber, a plunger in the bottom of said first chamber and mounted for movement only in the upward direction to form the bottom of said first chamber and control the volume of said first chamber to maintain said first chamber filled with said first fluid, said spout being tiltable to force said first fluid and said second fluid to mix in said mixing chamber and be jointly discharged from said spout, and ridges on the inner surface of said mixing chamber associated with said mixing ports to prevent said ball valve from closing said mixing ports from preventing the mixed fluids to flow through said spout.

2. The dispenser of claim 1 including a valve seat in said mixing chamber, and a ball valve in said mixing chamber in contact with said valve seat when said spout is in its non-dispensing position to prevent said first fluid from entering said mixing chamber.

3. The dispenser of claim 1 wherein said mixing chamber includes inwardly tapered surfaces defining an upper neck and a lower neck of lesser diameter than the diameter of said ball valve to trap said ball valve in said mixing chamber between said upper neck and said lower neck and said lower neck comprising said valve seat.

4. The dispenser of claim 3 wherein said mixing ports and said ridges are at said upper neck.

5. The dispenser of claim 4 wherein an outwardly diverging skirt extends from said lower neck into said first chamber for providing a flow channel for said first fluid.

6. The dispenser of claim 5 wherein said plunger is mounted in said first chamber on spring fingers reacting against the inner wall of said first chamber.

7. The dispenser of claim 6 wherein said first and fluids are different colored toothpastes.

8. The dispenser of claim 7 wherein said second fluid with said first fluid by providing a plurality of spaced stripes on the surface of said first fluid.

9. The dispenser of claim 8 including a diaphragm connected to said mixing chamber and separating said first chamber from said second chamber.

10. A dispenser for dispensing two distinct fluids from a common outlet comprising a container open at its bottom and closed at its top, a dispensing spout at said top of said container in communication with the interior of said container, a first chamber in said container extending from the lower end of said container to the upper end of said container, a first fluid in said first chamber, a second chamber in said container at said upper end, a second fluid in said second chamber, an axially disposed mixing chamber communicating with said spout and with said first chamber and with said second chamber, said second chamber being a sleeve around said mixing chamber, said mixing chamber being an extension of said spout at the lower end of said spout, said mixing chamber being open at its lower end and in axial communication with said first chamber, mixing ports around the periphery of said mixing chamber communicating with said second chamber whereby said second fluid may flow through said ports and mix with said first fluid in said mixing chamber, a plunger in the bottom of said first chamber and mounted for movement only in the upward direction to form the bottom of said first chamber and control the volume of said first chamber to maintain said first chamber filled with said first fluid, said spout being tiltable to force said first fluid and said second fluid to mix in said mixing chamber and be jointly discharged from said spout, and a diaphragm connected to said mixing chamber and separating said first chamber from said second chamber.

* * * * *